US008018130B2

(12) United States Patent
Van Den Broek et al.

(10) Patent No.: US 8,018,130 B2
(45) Date of Patent: Sep. 13, 2011

(54) LOW-PRESSURE MERCURY VAPOR DISCHARGE LAMP WITH AMALGAM

(75) Inventors: Antonius Cornelis Van Den Broek, Roosendall (NL); John Elen, Turnhout (BE); Frank Kloek, Roosendaal (NL); Koen Lenaerts, Turnhout (BE); Heleen Esch, Turnhout (BE); Jaak Geboers, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 504 days.

(21) Appl. No.: 12/278,291

(22) PCT Filed: Jan. 30, 2007

(86) PCT No.: PCT/IB2007/050304

§ 371 (c)(1),
(2), (4) Date: Aug. 5, 2008

(87) PCT Pub. No.: WO2007/091187

PCT Pub. Date: Aug. 16, 2007

(65) Prior Publication Data

US 2009/0026965 A1 Jan. 29, 2009

(30) Foreign Application Priority Data

Feb. 10, 2006 (EP) ..... 06101521

(51) Int. Cl.
*H01J 61/20* (2006.01)

(52) U.S. Cl. ..... 313/490; 313/550; 313/13; 313/639; 313/547; 315/115; 315/86; 315/56; 315/57

(58) Field of Classification Search ..... 313/490, 313/549; 315/209 SC, 209 M, 209 CD, 209 T, 315/209 R, 112–118, 158
See application file for complete search history.

(56) References Cited

U.S. PATENT DOCUMENTS

| | | | | |
|---|---|---|---|---|
| 3,336,502 | A | 8/1967 | Gilliatt | |
| 3,851,207 | A | 11/1974 | McVey | |
| 3,859,555 | A | 1/1975 | Latassa et al. | |
| 4,321,506 | A * | 3/1982 | Tsuchihashi et al. | 315/35 |
| 4,437,041 | A | 3/1984 | Roberts | |
| 4,827,313 | A | 5/1989 | Corona | |
| 5,095,336 | A | 3/1992 | Corona et al. | |
| 5,274,305 | A | 12/1993 | Bouchard | |
| 5,294,867 | A * | 3/1994 | Grossman | 313/490 |
| 5,465,028 | A * | 11/1995 | Antonis et al. | 315/248 |
| 6,172,452 | B1 * | 1/2001 | Itaya et al. | 313/490 |
| 6,337,539 | B1 * | 1/2002 | Yorifuji et al. | 315/56 |
| 6,461,520 | B1 * | 10/2002 | Engelhard et al. | 210/748.12 |
| 7,358,677 | B2 * | 4/2008 | Gielen | 315/34 |
| 2004/0195954 | A1 * | 10/2004 | Pirovic | 313/490 |

(Continued)

FOREIGN PATENT DOCUMENTS

CN 1489176 A 4/2004

(Continued)

*Primary Examiner* — Vibol Tan

(57) ABSTRACT

The invention relates to a lamp system comprising a low-pressure mercury vapor discharge lamp having a discharge vessel (6) enclosing a discharge space (8), with two electrodes (10, 30) positioned in the discharge vessel and an amalgam (18) arranged at a first end section (28) outside the discharge path between the first electrode and the second electrode. A ballast generates an electrical discharge current independently of an electrical heating current. A heating element (22) is positioned in the first end section for heating the amalgam using the electrical heating current. The temperature of the amalgam can be kept within its optimal temperature range for a relatively broad range of operating conditions.

19 Claims, 8 Drawing Sheets

U.S. PATENT DOCUMENTS

| | | | | |
|---|---|---|---|---|
| 2006/0267495 | A1* | 11/2006 | Pirovic | 313/547 |
| 2008/0252218 | A1* | 10/2008 | Waumans | 315/86 |

FOREIGN PATENT DOCUMENTS

| | | | |
|---|---|---|---|
| CN | 1710702 | A | 12/2005 |
| GB | 1062141 | A | 3/1967 |
| GB | 2316246 | A | 2/1998 |
| JP | 61071540 | A | 4/1986 |
| JP | 6362144 | A | 3/1988 |
| JP | 01253198 | A | 10/1989 |
| JP | 2003234084 | A | 8/2003 |
| JP | 2003346712 | A | 12/2003 |
| WO | 03045117 | A1 | 5/2003 |
| WO | 03060950 | A2 | 7/2003 |
| WO | 2004089429 | A2 | 10/2004 |
| WO | 2004114360 | A2 | 12/2004 |

* cited by examiner

LOW-PRESSURE MERCURY VAPOR DISCHARGE LAMP WITH AMALGAM

TECHNICAL FIELD

The invention relates to a lamp system comprising a low-pressure mercury vapor discharge lamp, the lamp comprising at least one discharge vessel enclosing, in a gastight manner, a discharge space provided with a filling of mercury and a rare gas, the discharge vessel having a first end section and a second end section, a first electrode arranged at the first end section and a second electrode arranged at the second end section for maintaining a discharge along a discharge path between the first electrode and the second electrode, and an amalgam for regulating the mercury vapor pressure in the discharge vessel and having an optimal temperature range, arranged at the first end section outside the discharge path. The invention further relates to a water treatment system or an air treatment system comprising said lamp system. The invention also relates to a low-pressure mercury vapor discharge lamp for said lamp system. The invention also further relates to the use of said lamp system.

BACKGROUND

In low-pressure mercury vapor discharge lamps, mercury constitutes the primary component for the generation of ultraviolet (UV) radiation. A luminescent layer comprising a luminescent material, for example a fluorescent powder, may be present on an inner wall of the discharge vessel to convert UV radiation to radiation of other wavelengths, for example, to UV-B and UV-A radiation for tanning purposes or to visible radiation for general illumination purposes. Such discharge lamps are therefore also referred to as fluorescent lamps. Alternatively, the ultraviolet light generated may be used for manufacturing germicidal lamps (UV-C). The discharge vessel of a low-pressure mercury vapor discharge lamp is usually circular and comprises both elongate and compact embodiments. Generally, the tubular discharge vessel of compact fluorescent lamps comprises a collection of relatively short straight parts having a relatively small diameter, which straight parts are connected together by means of bridge parts or via bent parts. The means for maintaining a discharge in the discharge space may be electrodes arranged in the discharge space. Alternatively, external electrodes can be applied. External electrodes can be provided as a conductive coating at the end parts of the discharge vessel. The conductive coatings function as a capacitive electrode, between which a discharge extends during lamp operation along the axial distance between the external electrodes.

Low-pressure mercury vapor discharge germicidal lamps predominantly generate UV-C radiation, and these types of lamps are used for disinfection of water and air, disinfection of foods, curing of inks and coatings, and destroying of pollutants in water and air. The principal radiation that is generated in such lamps has a wavelength of 254 nm, which prevents the growth of, for example, moulds and bacteria.

The mercury vapor pressure greatly affects the operation of a low-pressure mercury vapor discharge (germicidal) lamp. For an efficient operation of the lamp, a predetermined range of the mercury vapor pressure inside the discharge vessel is required. By using an amalgam, the mercury vapor pressure can be controlled within this predetermined range for a relatively broad temperature range, allowing operating the lamp at a high efficiency and hence a relatively high radiation output within this temperature range. In the description and claims of the current invention, the designation "optimal temperature range" for an amalgam is used to refer to the temperature range where the mercury vapor pressure is such that the radiation output of the lamp is at least 90% of the maximal radiation output, i.e. under operating conditions where the mercury vapor pressure is optimal. Lamp efficiency is defined as the UV-C output power divided by the lamp input power. The published international patent application WO2004/089429A2 discloses a low-pressure mercury vapor discharge germicidal lamp with an amalgam positioned in an end section of the lamp, allowing efficient operation of the lamp over a relatively wide temperature range. However, under certain conditions the temperature may change in such a way that the temperature of the amalgam is outside its optimal temperature range. For example, in certain applications a (germicidal) lamp has to be dimmable, i.e. reduction in the input power of the lamp in order to reduce the UV radiation output under conditions where a maximal output is not required. In case the lamp is dimmed, the temperature of the lamp will decrease. Furthermore, when using germicidal lamps for waste water treatment, for disinfection of drinking water, or for air treatment, a decrease in the temperature of the water or air causes the temperature of the lamp to decrease. The positioning of the (germicidal) lamp, i.e. horizontal versus vertical positioning of the lamp, also influences the temperature of the amalgam. Under these conditions the efficiency of the lamp decreases when the temperature of the amalgam becomes below its optimal temperature range.

DISCLOSURE OF INVENTION

It is an object of the invention to provide an efficient lamp system that at least partially solves the above-mentioned problem.

This object is achieved with a lamp system according to the invention, characterized in that the lamp further comprises a heating element arranged at the first end section for heating the amalgam to a temperature within its optimal temperature range, and in that the lamp system further comprises an electronic circuit arranged to generate an electrical discharge current for maintaining the discharge and an electrical heating current for heating the heating element, independently of the electrical discharge current, and a control circuit for generating at least one control signal to activate the electronic circuit to generate the electrical heating current. The amalgam is placed in the end section of the lamp, behind the electrode, in a relatively cool region of the lamp. The amalgam is positioned at the first end section such that in case the lamp operates at maximal input power, the temperature of the amalgam will not exceed the maximum value of its optimal temperature range, so that an optimal mercury-vapor pressure is achieved. The heating element is positioned adjacent to the amalgam. In case the temperature of the amalgam decreases to below its optimal temperature range, for example as a result of dimming the lamp or a decrease in temperature of the surroundings of the lamp, a control circuit activates the electronic circuit of the lamp system to generate an electric current that causes the heating element to heat the amalgam, resulting in an increase of the temperature of the amalgam to within its optimal temperature range. Lamp systems according to the invention operate at a relatively high efficiency over a relatively broad range of operating conditions, such as dimming level, temperature of the surroundings and positioning of the lamp, allowing to minimize the number of (germicidal) lamps required for a specific application, and thus reducing installation costs as well as maintenance costs.

It is noted that an electronic circuit for energizing a gas discharge lamp that generates an electrical discharge current independently of an electrical heating current is known per se. For example, British patent application GB2316246A discloses a power generator provided with a separate heater circuitry for heating the electrodes of a fluorescent lamp. The heater circuitry maintains the electrodes at a particular temperature. International patent application WO03/045117A1 discloses an electronic ballast, see for example FIG. 3, for operating a discharge lamp having a first switch mode power supply for supplying a discharge current to the lamp and a second switch mode power supply for heating the electrodes of the lamp. The second switch mode power supply is equipped with a power control loop comprising a memory for storing at least one electrode heating reference value.

Another preferred embodiment of the lamp system according to the invention is characterized in that the first electrode and the second electrode are arranged in the discharge space.

Another preferred embodiment of the lamp system according to the invention is characterized in that the heating element is arranged to heat the amalgam independently of the first electrode. Another preferred embodiment of the lamp system according to the invention is characterized in that the heating element is a filament circuit. By using a separate filament circuit for heating the amalgam, the temperature of the amalgam can be controlled independently of that of the electrodes of the lamp.

Another preferred embodiment of the lamp system according to the invention is characterized in that the first electrode is further arranged to operate as the heating element. By using the first electrode for heating the amalgam, a relatively simple construction for controlling the amalgam temperature is provided.

Another preferred embodiment of the lamp system according to the invention is characterized in that the first end section comprises a pressed end for sealing the first end section in a gastight manner, and that the amalgam is positioned in a recess of the pressed end on the side facing the discharge vessel. Another preferred embodiment of the lamp system according to the invention is characterized by a container, encapsulating the amalgam, adjacent to the heating element and having a gas opening enabling the exchange of mercury with the discharge space. Another preferred embodiment of the lamp system according to the invention is characterized by current supply conductors that issue through the first end section to outside the discharge vessel, the first electrode being coupled to the current supply conductors and the amalgam being supported by at least one current supply conductor. In these embodiments, the amalgam is positioned at a fixed distance from the heating element, at a position where the temperature differences in case of dimming the lamp or in case of a change in temperature of the surroundings of the lamp, for example, are relatively small compared to other positions within the discharge space. Furthermore, in case the lamp is positioned in a vertical position, the amalgam is kept in its position during use of the lamp, even under operating conditions that cause the amalgam to melt.

Another preferred embodiment of the lamp system according to the invention is characterized in that the control circuit is programmable to generate the at least one control signal in dependence on the dimming level of the lamp. When dimming the lamp, the temperature of the amalgam can be kept within its optimal temperature range.

Another preferred embodiment of the lamp system according to the invention is characterized in that the control circuit is further programmable to generate the at least one control signal in dependence on the measured voltage level of the lamp. The measured lamp voltage level is an indication of the efficiency of the lamp. A drop in the measured lamp voltage level is hence an indication that the temperature of the amalgam will decrease and heating of the amalgam may be required.

Another preferred embodiment of the lamp system according to the invention is characterized in that the control circuit is further programmable to generate the at least one control signal in dependence on the temperature level of the surroundings of the lamp. In case the temperature of the waste water or the air surrounding the lamp, for example, changes to a lower level, the temperature of the amalgam can be kept within its optimal temperature range.

Another preferred embodiment of the lamp system according to the invention is characterized by a temperature sensor for measuring the temperature level at a position near the amalgam, and by the control circuit being programmable to generate the at least one control signal in dependence on the temperature level provided by the temperature sensor. By using the temperature value at a position near the amalgam for controlling the heating element, a direct and more accurate control of the temperature of the amalgam can be obtained under a broad range of conditions.

According to the invention, a water treatment system or an air treatment system comprises at least one lamp system according to the invention. Lamp systems according to the invention operate at a relatively high efficiency over a relatively wide temperature range of the lamp and a wide range of operating conditions, allowing to minimize the number of germicidal lamps required for a specific water treatment system or air treatment system and thus reducing installation costs as well as maintenance costs. As the amalgam is positioned within a relatively cool region of the discharge space, it can be prevented that the amalgam melts during operation of the germicidal lamps and consequently moves out of position when the germicidal lamp is used in a vertical position.

According to the invention, a low-pressure mercury vapor discharge lamp presents all the features of the lamp disclosed in claim 3.

According to the invention, use of the lamp system according to claim 1 for disinfection of water, waste water or air is claimed by claim 15.

BRIEF DESCRIPTION OF DRAWINGS

The Figures are purely diagrammatic and not drawn to scale. Notably, some dimensions are shown strongly exaggerated for the sake of clarity. Similar components in the Figures are denoted by the same reference numerals as much as possible.

DESCRIPTION OF PREFERRED EMBODIMENTS

Figure 1:
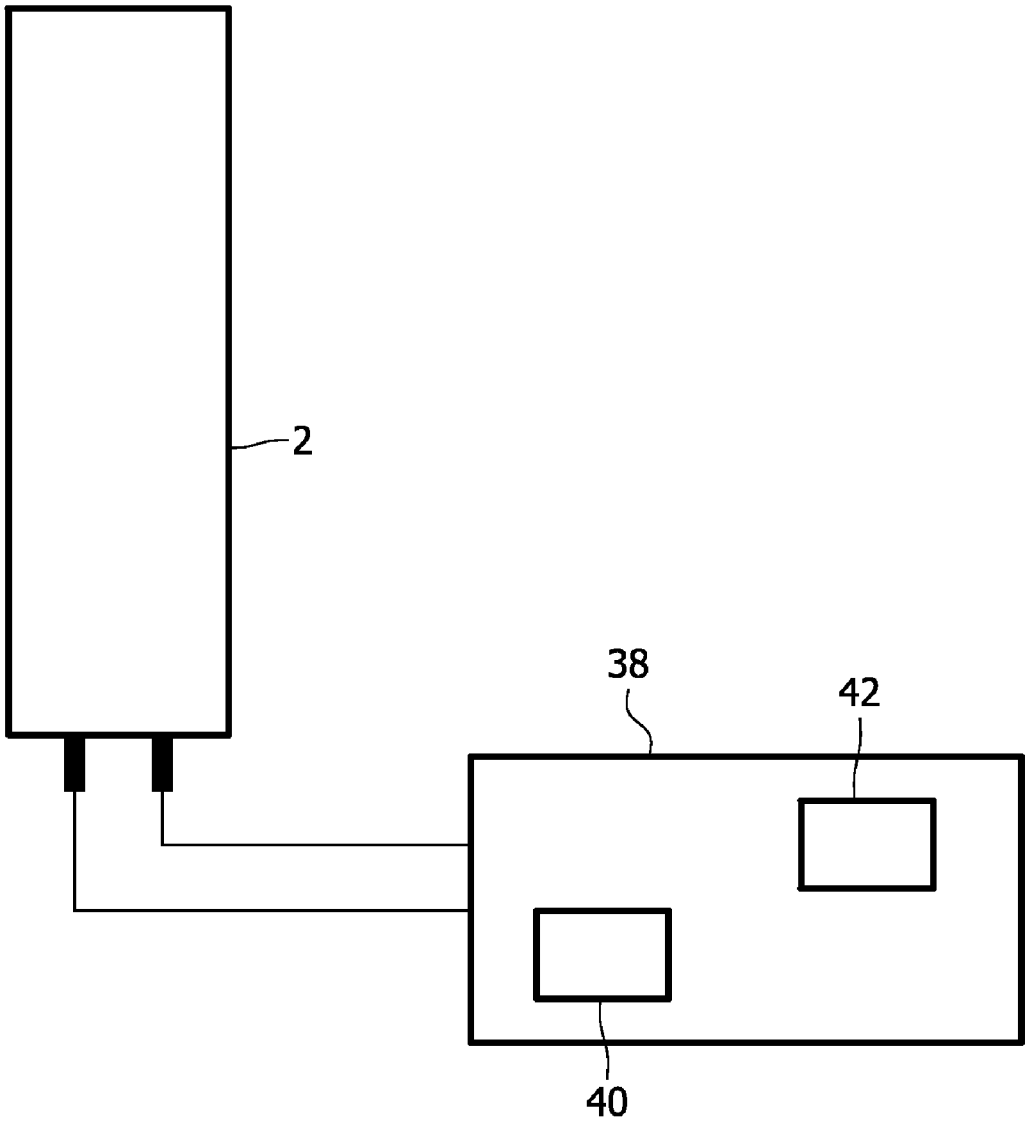
FIG. 1 is a schematic drawing of an embodiment of a lamp system according to the invention.

FIG. 1 is a schematic drawing of an embodiment of a lamp system according to the invention. The lamp system comprises a low-pressure mercury vapor discharge lamp 2 according to FIGS. 2-6. The system further comprises a lamp ballast 38 for energizing the lamp 2. The lamp ballast 38 comprises a controller 40 and a heating circuit 42. In an alternative embodiment, the controller 40 and/or the heating circuit 42 may be a separate device.

Figure 2:
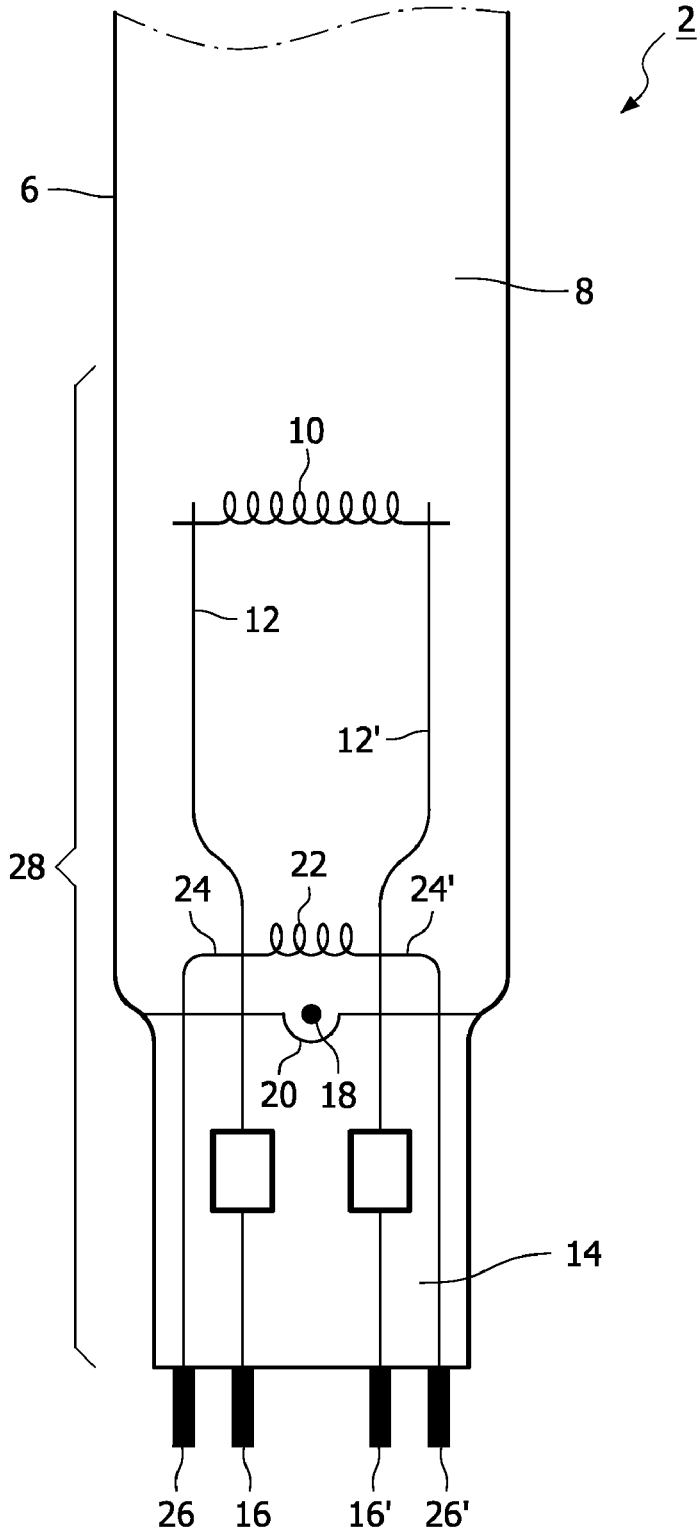
FIG. 2 is a schematic drawing of a first embodiment of a low-pressure mercury vapor discharge lamp for a system according to FIG. 1.
Figure 3:
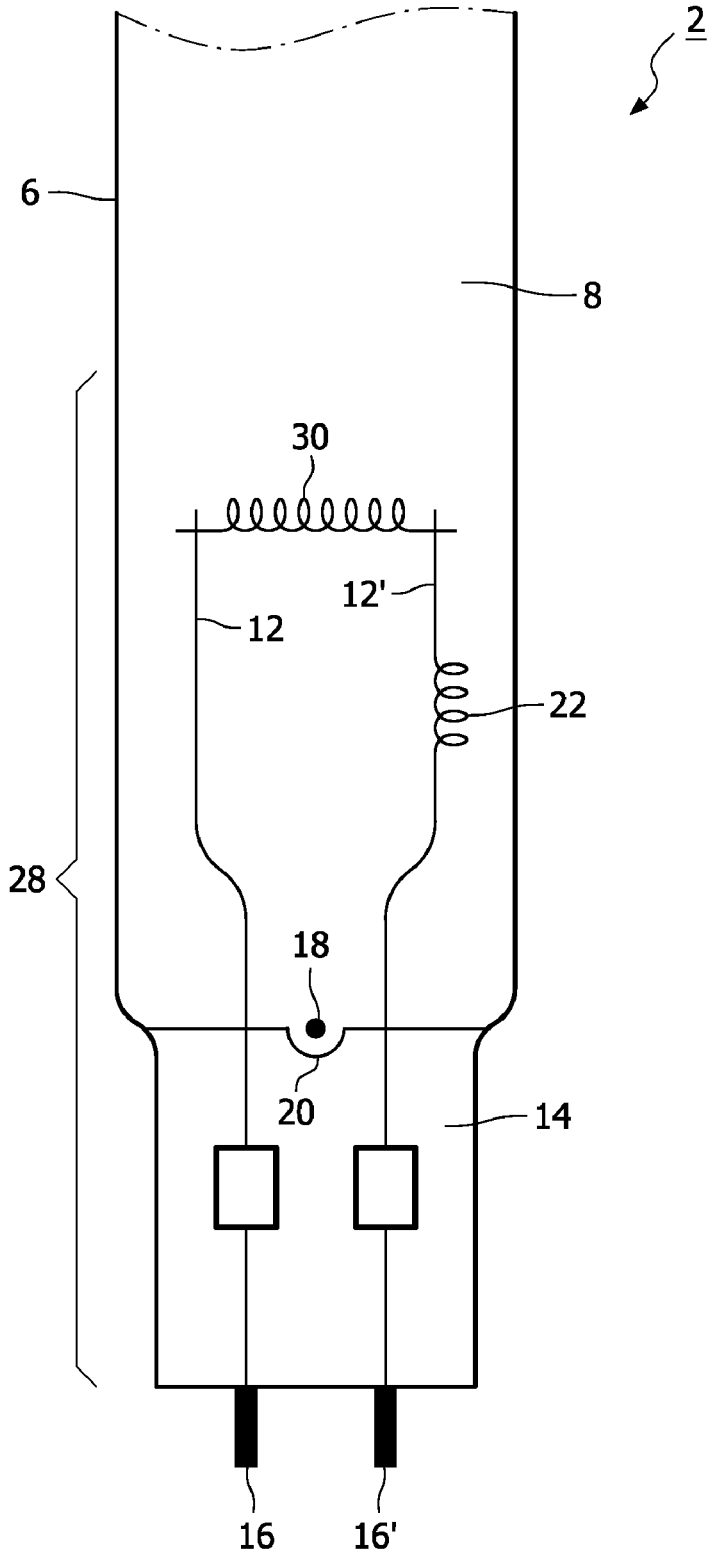
FIG. 3 is a schematic drawing of a second embodiment of a low-pressure mercury vapor discharge lamp for a system according to FIG. 1.

FIGS. 2 and 3 are schematic drawings of a first and a second embodiment, respectively, of a low-pressure mercury vapor discharge (germicidal) lamp for the lamp system as shown in FIG. 1. The lamp 2 has a gas discharge vessel 6 that encloses, in a gastight manner, a discharge space 8 containing a filling of mercury and an inert gas, for example argon. For clarity reasons, only a part of the lamp 2 is shown. The lamp 2 has two electrodes, of which only electrode 10, 30 is shown. Electrode 10, 30 is positioned in a first end section 28 of the germicidal lamp 2, and a second electrode is positioned in a second end section of the lamp, for maintaining a discharge in the discharge space 8. Alternatively, the electrodes are external electrodes. The electrode 10, 30 is a winding of tungsten covered with an electron-emitting substance, for example a mixture of barium oxide, calcium oxide and strontium oxide. Current-supply conductors 12, 12' are coupled to the electrode 10, 30 and pass through the sealed end 14 of the lamp to the exterior. The current-supply conductors 12, 12' are connected to contact pins 16, 16'. The sealed end 14 has a recess 20, in which an amalgam 18 is positioned. The recess 20 has an opening facing the discharge space 8 for exchange of mercury between the amalgam 18 and the discharge space 8. The lamp 2 further comprises a filament circuit 22 that is positioned adjacent to the amalgam 18. Referring to FIG. 2, current-supply conductors 24, 24' are coupled to the filament circuit 22 and pass through the sealed end 14 to the exterior. The current-supply conductors 24, 24' are connected to contact pins 26, 26'. Referring to FIG. 3, the filament 22 is integrated into the current supply conductor 12'. Referring again to FIGS. 2 and 3, the lamp ballast 38 is arranged to generate a discharge current for energizing the electrode 10, 30, via contact pins 16, 16' and current-supply conductors 12, 12'. Using this discharge current, a gas discharge is maintained between the electrode 10, 30 and the other electrode during normal operation of the lamp. The lamp ballast 38 is further arranged to generate a first heating current via the heating circuit 42, independently of the discharge current, for heating the filament circuit 22, via contact pins 26, 26' and current-supply conductors 24, 24' (FIG. 2) or via contact pins 16, 16' and current-supply conductors 12, 12' (FIG. 3). It is noted that in the embodiment of FIG. 3, the same heating current is applied to the filament circuit 22 and the electrode 30, but this heating current can be generated independently of the discharge current. The controller 40 is arranged to generate a control signal to activate the ballast to generate the first heating current. In addition, the lamp ballast 38 may also generate a second heating current for heating the electrode 10, 30, for example during start-up of the lamp 2, via contact pins 16, 16' and current-supply conductors 12, 12'. The amalgam 18 has a specific optimal temperature range, depending on its composition. For example, for an amalgam comprising Indium, this range is from 110 to 140° C. The amalgam is positioned at the first end section 28 such that in case the germicidal lamp 2 operates at maximal input power, the temperature of the amalgam will not exceed the maximum value of its optimal temperature range, so that an optimal mercury-vapor pressure is achieved. Referring to FIG. 2, in an alternative embodiment, a shield, not shown in FIG. 2, is positioned between the filament circuit 22 and the electrode 10, to create a separate chamber in which the filament circuit 22 is positioned. The shield has openings for allowing exchange of mercury between the amalgam 18 and the discharge space 8. Referring again to FIG. 2, in an alternative embodiment the filament circuit 22 is positioned around at least a part of the sealed end 14 and is energized via current-supply conductors 24, 24'. In a further alternative embodiment, the filament circuit is positioned inside at least a part of the sealed end 14. During operation, the filament circuit 22 heats the amalgam 18 inside the recess 20 by heating the sealed end 14.

Figure 4:
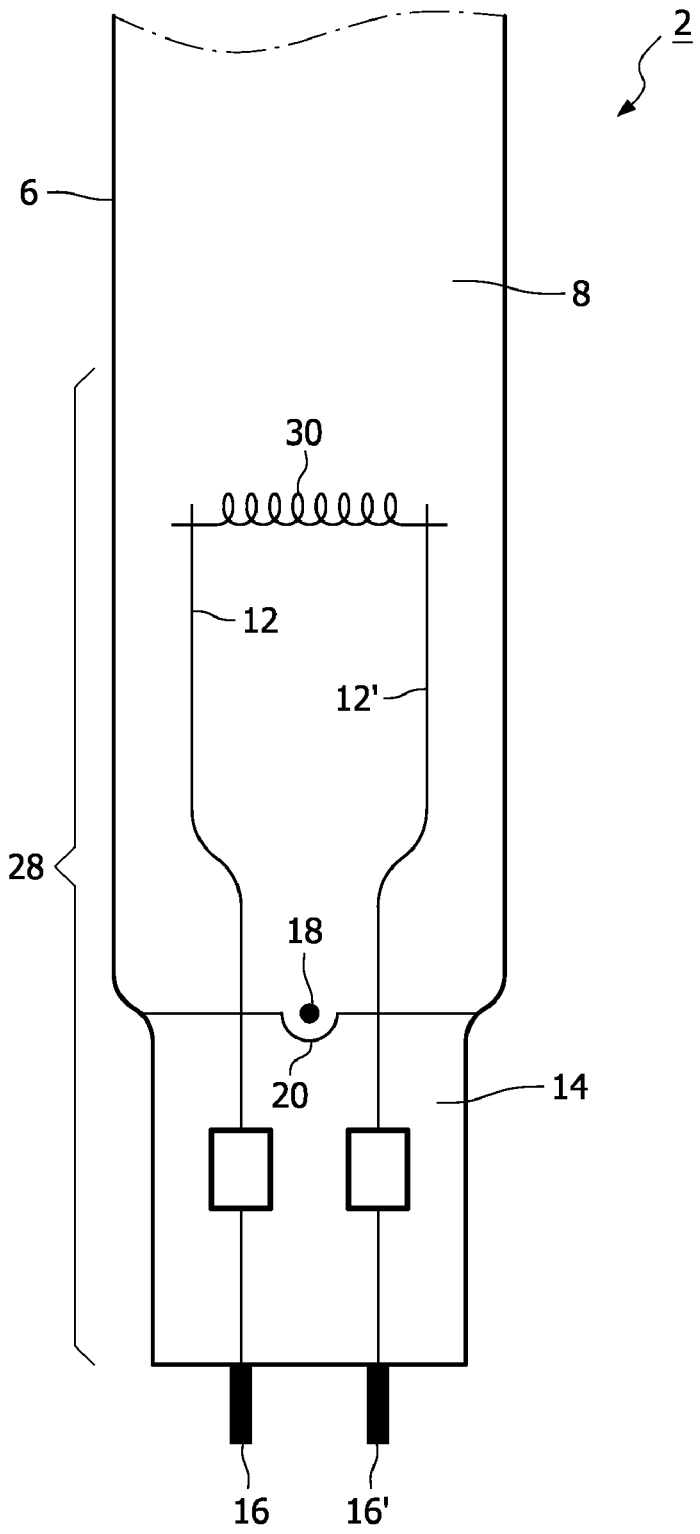
FIG. 4 is a schematic drawing of a third embodiment of a low-pressure mercury vapor discharge lamp for a system according to FIG. 1.
Figure 5:
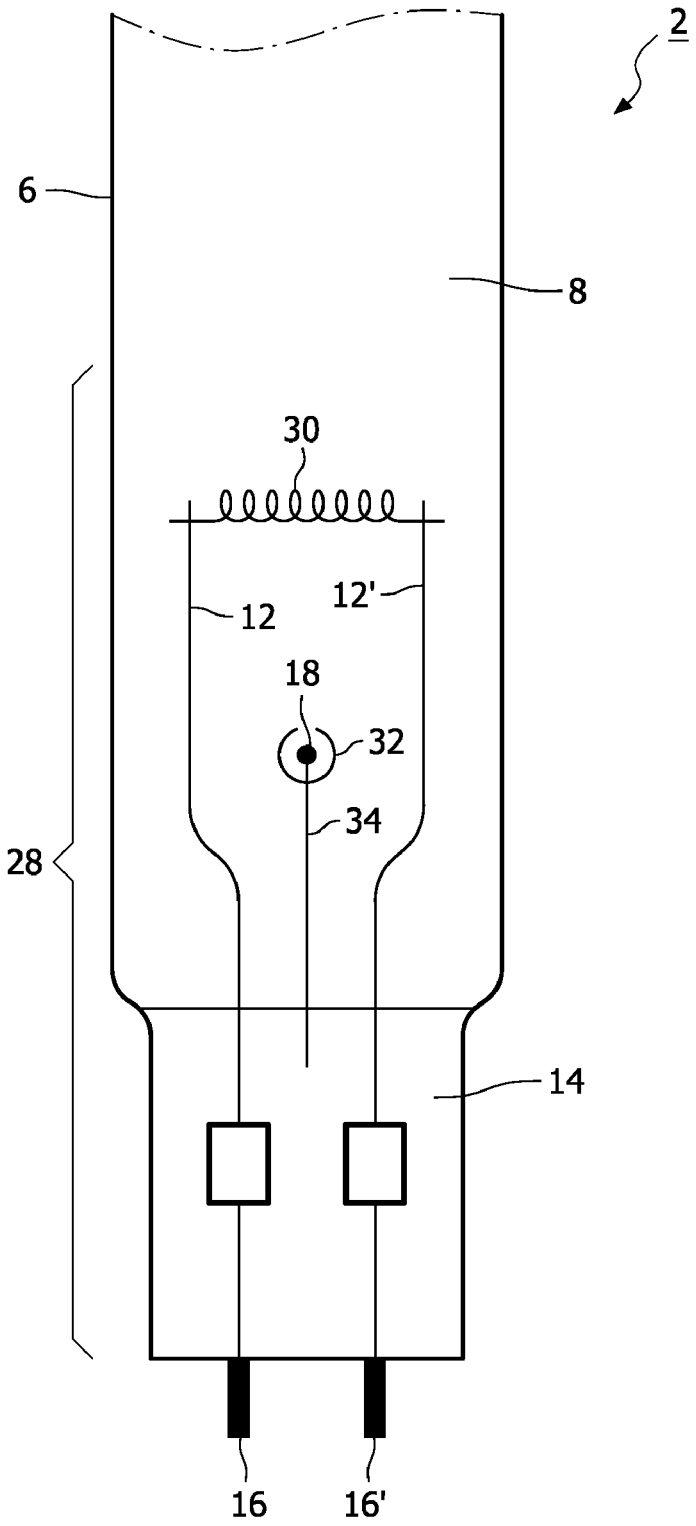
FIG. 5 is a schematic drawing of a fourth embodiment of a low-pressure mercury vapor discharge lamp for a system according to FIG. 1.
Figure 6:
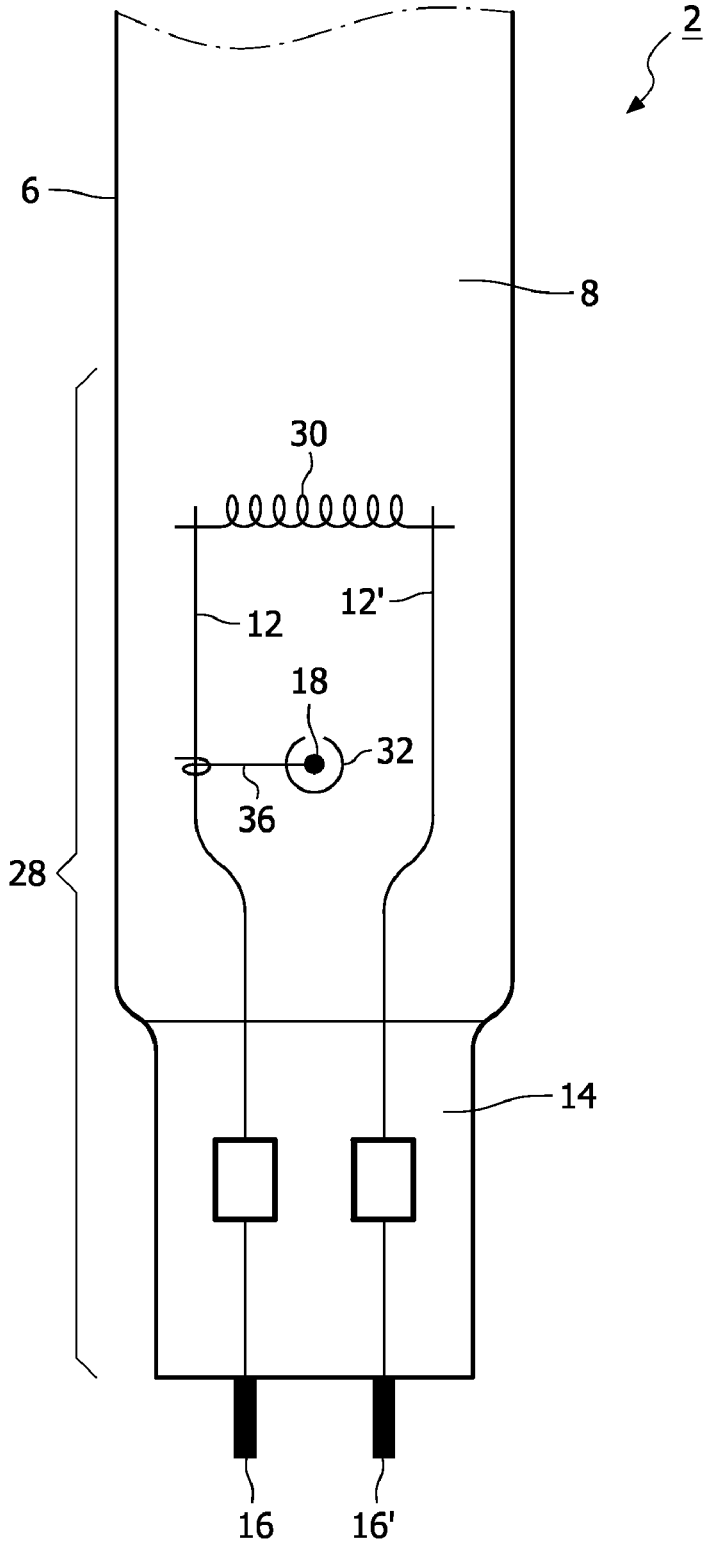
FIG. 6 is a schematic drawing of a fifth embodiment of a low-pressure mercury vapor discharge lamp for a system according to FIG. 1.

FIGS. 4, 5 and 6 are schematic drawings of a third, fourth and fifth embodiment, respectively, of a low-pressure mercury vapor discharge (germicidal) lamp for a lamp system according to FIG. 1. Referring to FIGS. 4, 5 and 6, for clarity reasons, only a part of the lamp 2 is shown. The lamp 2 has a gas discharge vessel 6 that encloses a discharge space 8 containing a filling of mercury and an inert gas mixture, for example argon. The lamp 2 has two electrodes, of which only electrode 30 is shown. Electrode 30 is positioned in a first end section 28 of the lamp 2, and a second electrode is positioned in a second end section of the lamp, for maintaining a discharge in the discharge space 8. Alternatively, the electrodes are external electrodes. Current-supply conductors 12, 12' are coupled to the electrode 30 and pass through the sealed end 14 of the lamp to the exterior. The current-supply conductors 12, 12' are connected to contact pins 16, 16'. The lamp ballast 38 is arranged to generate a discharge current for energizing the electrode 30, via contact pins 16, 16 and current-supply conductors 12, 12'. Using this discharge current, a gas discharge is maintained between the two electrodes during normal operation of the lamp. The lamp ballast 38 is further arranged to generate a first heating current via the heating circuit 42, independently of the discharge current, for heating the electrode 30, via contact pins 16, 16' and current-supply conductors 12, 12'. The controller 40 is arranged to generate a control signal to activate the ballast to generate the first heating current. In addition, the lamp ballast 38 may also generate a second heating current for heating the electrode 30, for example during start-up of the lamp 2, via contact pins 16, 16' and current-supply conductors 12, 12'. The lamp 2 comprises an amalgam 18 that is positioned at the first end section 28 such that in case the germicidal lamp 2 operates at maximal input power, the temperature of the amalgam will not exceed the maximum value of its optimal temperature range, so that an optimal mercury-vapor pressure is achieved. Referring to FIG. 4, the amalgam 18 is positioned in a recess 20 in the sealed end 14. The sealed end 14 has a relatively uniform temperature at varying operation conditions of the germicidal lamp 2. Referring to FIG. 5, the amalgam 18 is positioned in a container 32 that is coupled to a metal strip 34. The other end of the metal strip 34 is connected to the sealed end 14. The container 32 has an opening for exchange of mercury between the amalgam 18 and the discharge space. Referring to FIG. 6, the amalgam 18 is positioned in a container 32 that is coupled to the current-supply conductor 12 via a strip 36 of a non-electrically conducting material.

In an embodiment of the lamp system, the controller 40 is programmable to generate the control signal in dependence on the dimming level of the (germicidal) lamp 2. In case the lamp 2 is dimmed in order to reduce the radiation output, the temperature profile along the longitudinal axis of the lamp 2 changes. As a result, the temperature of the amalgam 18 decreases and goes outside its optimal temperature range at a certain critical dimming level of the lamp 2. The controller 40 can be programmed in such a way that, at this dimming level, the controller generates a control signal to trigger the ballast 38 to generate a first heating current to the filament circuit 22 of FIGS. 2 and 3 or to the electrode 30 of FIGS. 4, 5 and 6, respectively, for heating the amalgam 18. The level of the first heating current, as generated by the heating circuit 42, is chosen such that the temperature of the amalgam 18 will increase to a level within its optimal temperature range. The relationship between the level of the first heating current and the dimming level, in order to achieve a temperature of the amalgam within its optimal temperature range, has to be determined separately by means of standard experiments and can subsequently be programmed into the controller. This relationship depends on, amongst others, the distance between the filament circuit 22 of FIGS. 2 and 3 or the electrode 30 of FIGS. 4, 5 and 6 and the amalgam 18, the diameter of the lamp, and the construction of the filament circuit 22 of FIGS. 2 and 3 or the electrode 30 of FIGS. 4, 5 and 6. In case the dimming level is subsequently increased to above the critical dimming level, the controller 40 generates a signal to trigger the ballast 38 to shut down the first heating current. In an alternative embodiment of the lamp system, the controller 40 is programmable to generate the control signal in dependence on the temperature level of the surroundings of the (germicidal) lamp, for example the water temperature. In case the temperature of the surroundings decreases, the temperature profile along the longitudinal axis of the lamp 2 changes. As a result, the temperature of the amalgam 18 decreases and goes outside its optimal temperature range at a certain temperature of the surroundings. The controller 40 can be programmed in such a way that at this temperature level of the surroundings of the lamp 2, the controller 40 generates a control signal to trigger the ballast to generate a first heating current to the filament circuit 22 of FIGS. 2 and 3 or to the electrode 30 of FIGS. 4, 5 and 6, respectively, for heating the amalgam 18. The level of the first heating current, as generated by the heating circuit 42, is chosen such that the temperature of the amalgam 18 will increase to a level within its optimal temperature range. In a further alternative embodiment, the controller 40 is programmable to generate the control signal in dependence on both the dimming level of the (germicidal) lamp 2 and the temperature of the surroundings of the germicidal lamp 2. The relationship between the required level of the first heating current and the dimming level of the lamp 2 and/or the temperature of the surroundings of the lamp can be determined separately and programmed into the controller 40 in a way known to the person skilled in the art. In another further alternative embodiment, the controller 40 is programmable to generate the control signal in dependence on the measured voltage level of the (germicidal) lamp 2. In case the measured voltage level of the lamp 2 drops, this is an indication of a reduction in the efficiency of the lamp. As a result, the temperature profile along the longitudinal axis of the lamp 2 changes. The temperature of the amalgam 18 decreases and goes outside its optimal temperature range at a certain critical measured voltage level of the lamp 2. The controller 40 can be programmed in such a way that at this measured lamp voltage level the controller generates a control signal to trigger the ballast 38 to generate a first heating current to the filament circuit 22 of FIGS. 2 and 3 or to the electrode 30 of FIGS. 4, 5 and 6, respectively, for heating the amalgam 18. In another further alternative embodiment of the lamp system, the (germicidal) lamp 2 further comprises a temperature sensor for measuring the temperature level at a position in the discharge vessel near the amalgam, and the controller 40 is programmable to generate the control signal in dependence on the temperature level. In case the measured temperature level indicates that the temperature of the amalgam is below its optimal temperature range, due to dimming of the lamp for example, the controller 40 generates a control signal to trigger the ballast 38 to generate a first heating current to heat the amalgam to a temperature level inside its optimal temperature range. The moment the temperature level, as measured, indicates that the temperature of the amalgam is within its optimal temperature range, the controller 40 generates a control signal to trigger the ballast 38 to shut down the first heating current.

Figure 7:
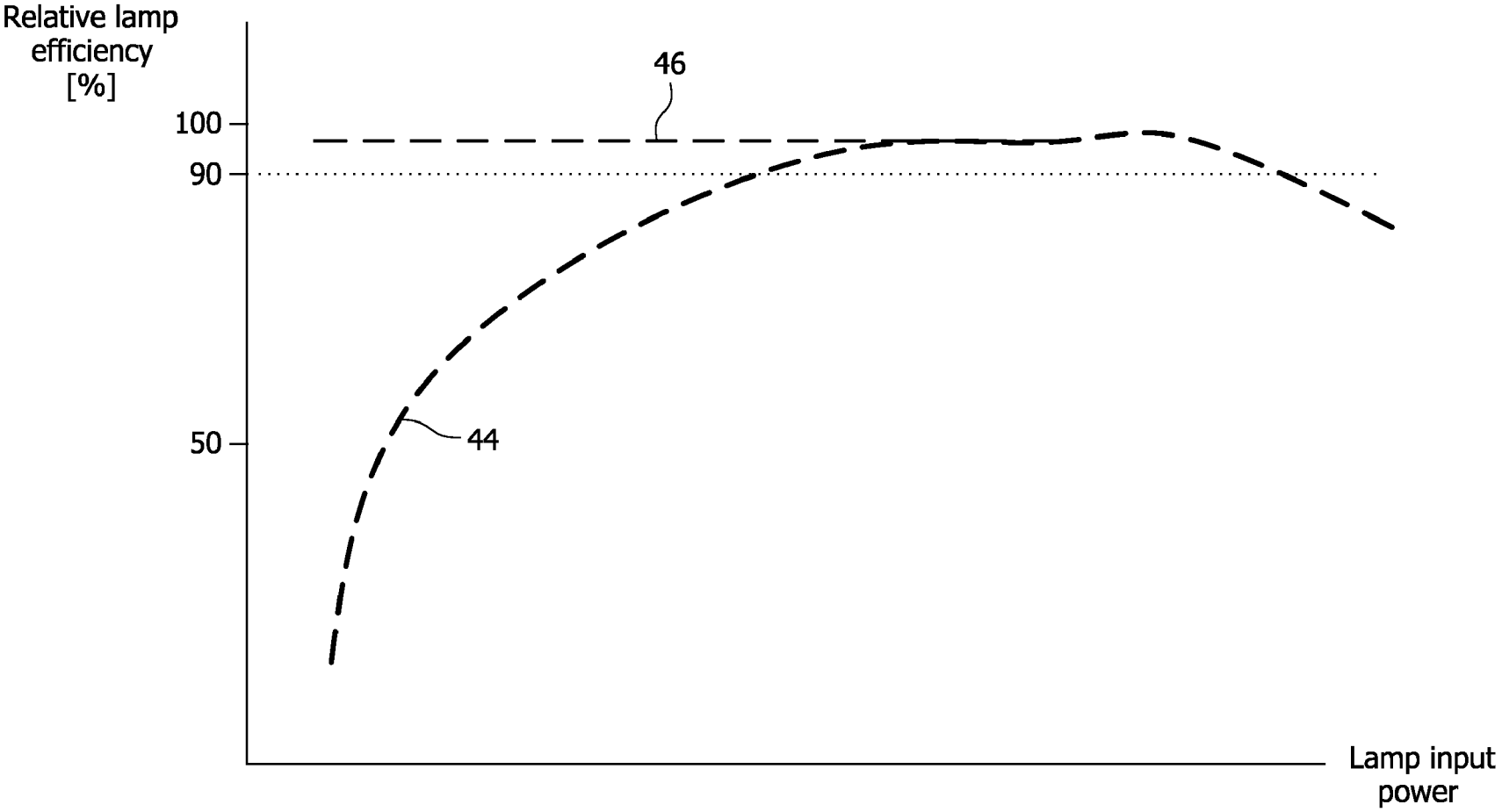
FIG. 7 shows the relative lamp efficiency versus the lamp input power for a low-pressure mercury vapor discharge lamp according to the prior art and a lamp system according to the invention.

FIG. 7 shows the relative lamp efficiency, i.e. the actual lamp efficiency divided by the lamp efficiency achieved when the radiation output is maximal, versus the lamp input power in Watt for a low-pressure mercury vapor discharge lamp according to the prior art and a lamp system according to the invention. Line 44 shows the relative lamp efficiency versus the lamp input power for a low-pressure mercury-vapor discharge lamp according to the prior art. At increasing lamp input power, the relative efficiency increases to reach a maximum, and decreases at further increasing lamp input power. Within a relatively small range of the lamp input power, the temperature of the amalgam is within its optimal temperature range and hence a lamp efficiency of 90% or higher is achieved. Line 46 shows the relative lamp efficiency versus the lamp input power for a lamp system according to the invention, comprising a lamp according to FIGS. 2-6. The amalgam is maintained at a temperature within its optimal temperature range when the lamp input power decreases and hence the relative lamp efficiency is maintained at a value of 90% or higher.

Figure 8:
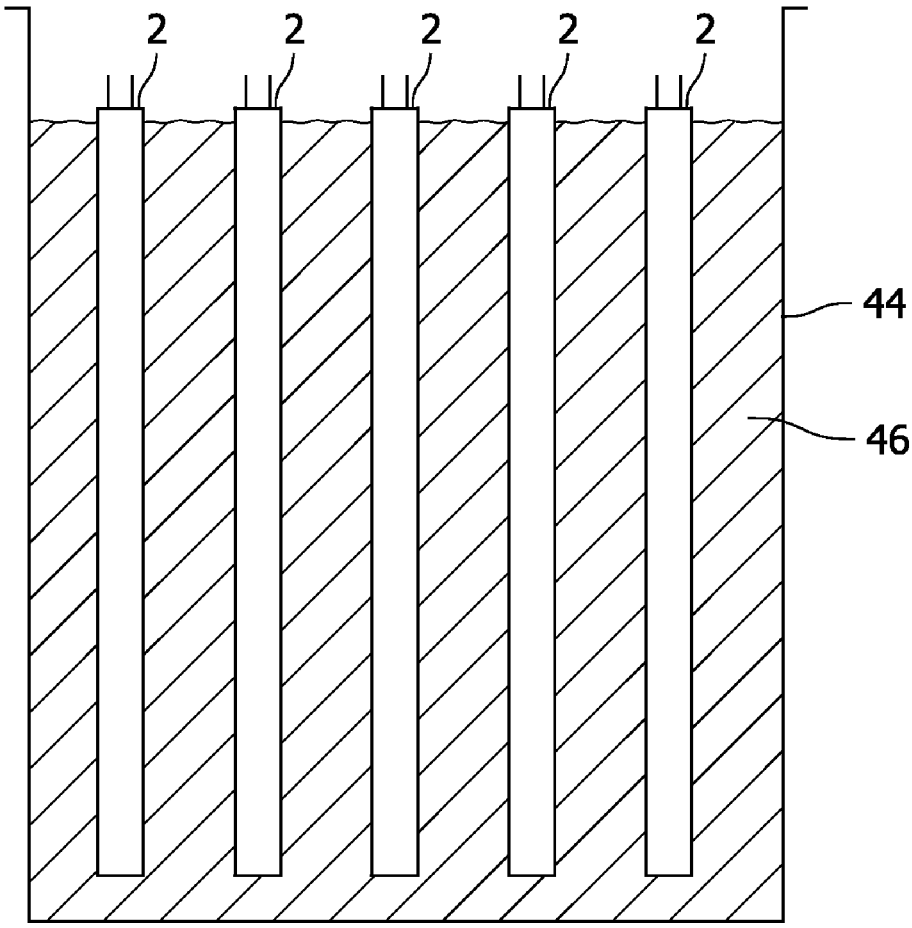
FIG. 8 is a schematic drawing of a water treatment system or air treatment system according to the invention.

FIG. 8 is a schematic drawing of a water treatment system or an air treatment system according to the invention, comprising a plurality of germicidal lamps 2. The germicidal lamps 2 are placed vertically into a container 44. Alternatively, the germicidal lamps 2 can be placed in a horizontal position. The water or air 46 flows around the germicidal lamps 2, is irradiated by the germicidal lamps 2, and the generated UV radiation disinfects and/or purifies the water or air. The germicidal lamps 2 have contact pins on one side of the lamp. Alternatively, they have contact pins on both sides of the lamp. The germicidal lamps 2 each have their own lamp ballast, not shown in FIG. 8. In an alternative embodiment, a single ballast is shared by two or more germicidal lamps 2. The germicidal lamps 2 may be placed into a protective sleeve. The water treatment system may be used for treating waste water or for treating drinking water, for example. The air treatment system can be used in air conditioning systems or ventilation systems, for example.

In an alternative embodiment, the germicidal lamps 2 can be used in a system for disinfection of food, or a system for curing inks or coatings.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lamp system comprising a low-pressure mercury vapor discharge lamp, the lamp comprising:

at least one discharge vessel enclosing, in a gastight manner, a discharge space including a filling of mercury and a rare gas, the discharge vessel having a first end section and a second end section, a first electrode arranged at the first end section and a second electrode arranged at the second end section for maintaining a discharge along a discharge path between the first electrode and the second electrode, an amalgam for regulating the mercury vapor pressure in the discharge vessel and having an optimal temperature range, arranged at the first end section outside the discharge path, a heating element arranged at the first end section for heating the amalgam independently of the first electrode to a temperature within its optimal temperature range, an electronic circuit arranged to generate an electrical discharge current for maintaining the discharge, and an electrical heating current for heating the heating element, independently of the electrical discharge current, a control circuit for generating at least one control signal to activate the electronic circuit to generate the electrical heating current, and current supply conductors configured to issue through the first end section to outside the discharge vessel, wherein the first electrode is coupled to the current supply conductors, and wherein the amalgam is supported by at least one current supply conductor.

2. A lamp system according to claim 1, wherein the first electrode and the second electrode are arranged in the discharge space.

3. A lamp system according to claim 1, wherein the heating element is a filament circuit.

4. A lamp system according to claim 1, wherein the first electrode is further arranged to operate as the heating element.

5. A lamp system according to claim 1, wherein the first end section comprises a pressed end for sealing the first end section in a gastight manner, and that the amalgam is positioned in a recess of the pressed end on the side facing the discharge vessel.

6. A lamp system according to claim 1, wherein a container, encapsulating the amalgam, adjacent to the heating element and having a gas opening enabling the exchange of mercury with the discharge space.

7. A lamp system according to claim 5, wherein the control circuit is programmable to generate the at least one control signal in dependence on the dimming level of the lamp.

8. A lamp system according to claim 5, wherein the control circuit is further programmable to generate the at least one control signal in dependence on the measured voltage level of the lamp.

9. A lamp system according to claim 5, wherein the control circuit is further programmable to generate the at least one control signal in dependence on the temperature level of the surroundings of the lamp.

10. A lamp system according to claim 5, by further comprising:

a temperature sensor for measuring the temperature level at a position near the amalgam, wherein the control circuit is configured to generate the at least one control signal in dependence on the temperature level provided by the temperature sensor.

11. A water treatment system or an air treatment system comprising at least one lamp system according to claim 1.

12. A low-pressure mercury vapor discharge lamp presenting all the features of the lamp disclosed in claim 1.

13. Use of a lamp system according to claim 1 for disinfection of water, waste water or air.

14. A lamp system comprising a low-pressure mercury vapor discharge lamp, the lamp system comprising:

at least one discharge vessel enclosing, in a gastight manner, a discharge space including a filling of mercury and a rare gas, the discharge vessel having a first end section and a second end section, a first electrode arranged at the first end section and a second electrode arranged at the second end section for maintaining a discharge along a discharge path between the first electrode and the second electrode, an amalgam for regulating the mercury vapor pressure in the discharge vessel and having an optimal temperature range, arranged at the first end section outside the discharge path, a heating element arranged at the first end section for heating the amalgam independently of the first electrode to a temperature within its optimal temperature range, an electronic circuit arranged to generate an electrical discharge current for maintaining the discharge, and an electrical heating current for heating the heating element, independently of the electrical discharge current, and a control circuit for generating at least one control signal to activate the electronic circuit to generate the electrical heating current, wherein the first end section includes a pressed end for sealing the first end section in a gastight manner, and wherein the amalgam is positioned in a recess of the pressed end on the side facing the discharge vessel, and wherein the control circuit is configured to generate the at least one control signal in dependence on at least one of a dimming level of the lamp, a measured voltage level of the lamp, a temperature level of surroundings of the lamp, or a temperature level at a position near the amalgam.

15. A lamp system comprising a low-pressure mercury vapor discharge lamp, the lamp comprising:

at least one discharge vessel enclosing, in a gastight manner, a discharge space including a filling of mercury and a rare gas, the discharge vessel having a first end section and a second end section, the first end section having a pressed end for sealing the first end section in a gastight manner, a first electrode arranged at the first end section and a second electrode arranged at the second end section for maintaining a discharge along a discharge path between the first electrode and the second electrode, an amalgam for regulating the mercury vapor pressure in the discharge vessel and having an optimal temperature range, the amalgam being positioned in a recess of the pressed end on the side facing the discharge vessel, wherein the first electrode is further arranged for heating the amalgam to a temperature within its optimal temperature range, an electronic circuit arranged to generate an electrical discharge current for maintaining the discharge, and an electrical heating current for heating the first electrode, independently of the electrical discharge current, and a control circuit for generating at least one control signal to activate the electronic circuit to generate the electrical heating current in dependence on at least a dimming level of the lamp.

16. A lamp system according to claim 15, wherein the first electrode and the second electrode are arranged in the discharge space.

17. A lamp system according to claim 15, further comprising a container encapsulating the amalgam, positioned in the recess and having a gas opening enabling the exchange of mercury with the discharge space.

18. A lamp system according to claim 15, wherein the control circuit is further programmable to generate the at least one control signal in dependence on the measured voltage level of the lamp or on the temperature level of the surroundings of the lamp.

19. A lamp system according to claim 15, further comprising a temperature sensor for measuring the temperature level at a position near the amalgam, wherein the control circuit is further programmable to generate the at least one control signal in dependence on the temperature level provided by the temperature sensor.

* * * * *